United States Patent [19]

Oppie et al.

[11] Patent Number: 4,811,702

[45] Date of Patent: Mar. 14, 1989

[54] INTAKE PORT FOR INTERNAL COMBUSTION ENGINES

[76] Inventors: Alfred L. Oppie; Peter Samish, both of 11349 Orcas Ave., Lakeview Terrace, Calif. 91342

[21] Appl. No.: 166,891

[22] Filed: Mar. 11, 1988

[51] Int. Cl.[4] ..... F02B 75/18

[52] U.S. Cl. ..... 123/188 M; 123/52 M

[58] Field of Search ..... 123/188 M, 52 M

[56] References Cited

U.S. PATENT DOCUMENTS 4,159,011 6/1979 Sperry ..... 123/52 M 4,503,819 3/1985 Okumura et al. ..... 123/188 M 4,606,308 8/1986 Furlong ..... 123/188 M

FOREIGN PATENT DOCUMENTS 2643648 7/1977 Fed. Rep. of Germany ... 123/188 M

*Primary Examiner*—E. Rollins Cross

[57] ABSTRACT

An improved intake port for an internal combustion engine, having an airfoil integral with the intake port, causing increased laminar flow to the air/fuel passing through the port. The push rod and guide pass through the center of the airfoil, allowing a straight through port, thus providing greater efficiencies to the air/fuel flow through the port.

2 Claims, 2 Drawing Sheets

| A | B-NUMBERS NOT CFM | C NUMBERS NOT CFM |
|---|---|---|
| .100 | 65 | 70 |
| .150 | 125 | 160 |
| .200 | 195 | 245 |
| .250 | 260 | 360 |
| .300 | 330 | 460 |
| .350 | 395 | 580 |
| .400 | 455 | 695 |
| .450 | 515 | 760 |
| .500 | 570 | 825 |
| .550 | 630 | 860 |
| .600 | 685 | 880 |
| .650 | 715 | 900 |
| .700 | 765 | 920 |

FIG. 3

INTAKE PORT FOR INTERNAL COMBUSTION ENGINES

BACKGROUND FIELD OF INVENTION

This invention relates to internal combustion engines, and specifically to an improved performance intake port.

BACKGROUND DESCRIPTION OF PRIOR ART

In the Sports of boat racing, drag racing, road racing and stock car racing the rules of play sometimes specify an internal combustion engine which precludes overhead cam engines. Also more generally, enthusiasts and manufacturers alike are always in search of a way to improve the performance of internal combustion engines. Costly means are used to increase efficiency by even a small amount to achieve additional performance of vehicles.

An overhead cam, for example may involve major engine overhaul features including; manufacturing a complete set of internal combustion heads, new cam shafts, new intake manifold, all new valves, and the like. A device which does not require such a great number of means to achieve an increase in efficiency in a traditional push rod engine, would be greatly useful in lowering the expense required to increase performance of an engine and provide an alternative to an overhead cam engine.

In the prior art, air/fuel intake ports are known which bend in multiple curves around the push rod and guide. This feature decreased the air/fuel flow to less than the optimum which is ideally obtained utilizing the shape of a straight through intake port.

The Ford Motor Co. in its development of the "Boss 429" engine series in 1968-69 ran the push rod and guide through the intake port, and straightened the intake port. This device assumed the air/fuel flow would not be influenced by this development of features. However, decreased air/fuel flow due to turbulence was encountered, and so Ford had to make a very large intake port. However, the air/fuel mixture which travels in suspension or atomization through the intake port, does not move at a sufficient velocity in the larger capacity port, such that the air/fuel mixture falls out of suspension. This causes pooling of fuel within the port body, and a resultant rough idling and poor off idle response. In any large capacity port of the prior art, the air/fuel mixture does not travel at sufficient velocity to correct this problem. The larger port with this problem of a loss of fuel and pressure, creates great inefficiencies, such as a lurching response especially at low r.p.m.'s.

Chevrolet also determined that the push rod and guide passing through the port caused turbulence and never pursued developments in this area.

A low cost solution to this problem is greatly needed.

OBJECTS AND ADVANTAGES

Accordingly, we claim the following as our objects and advantages of the invention:

to provide a substantially straight through intake port, thereby eliminating the losses in air/fuel flow encountered in a double bent intake port, and also allowing the advantage of being able to run larger diameter intake and exhaust valves, as a result of the fact that straight intake ports take up less room; to provide a device having the push rod and guide pass through the intake port, with the intake port at that location having an air foil shape to its section, thereby eliminating the turbulence caused by the push rod and guide introduction into the intake port. The air foil assembly causes substantially no flow losses (only those due to the increased surface area of the air foil itself), and therefore the intake port as taught in the device according to the present invention, will flow with efficiency approximately equal to a straight port with no airfoil section included in it, such as would be obtained in an overhead camshaft design, thereby giving a distinct and considerable advantage to engines utilizing a device as taught according to the present invention. The air/fuel flow travels around the push rod and air foil assembly without creating the turbulence and loss of efficiency obtained in devices of the prior art.

The cost of manufacturing the device according to the present invention is substantially less than other devices of the prior art obtaining similar efficiencies, such as overhead camshaft devices. The device of the present invention develops more horsepower throughout the entire r.p.m. range, due to the effect of increased air/fuel flow, than devices of the prior art.

The advantages of increased air/fuel flow over devices of the prior art as exhibited by a device according to the present invention, have been observed to be approximately at twenty percent, when tested on a flow bench.

The device according to the present invention can be utilized with any engine which is carburated or injected, but not on blown engines.

The device of the present invention gives the effect and advantages of an overhead cam intake port while still having the configuration and form of a push rod actuated valve system.

Readers will find further objects and advantages of the invention from a consideration of the ensuing description and the accompanying drawings.

DRAWING FIGURES

Figure 1:
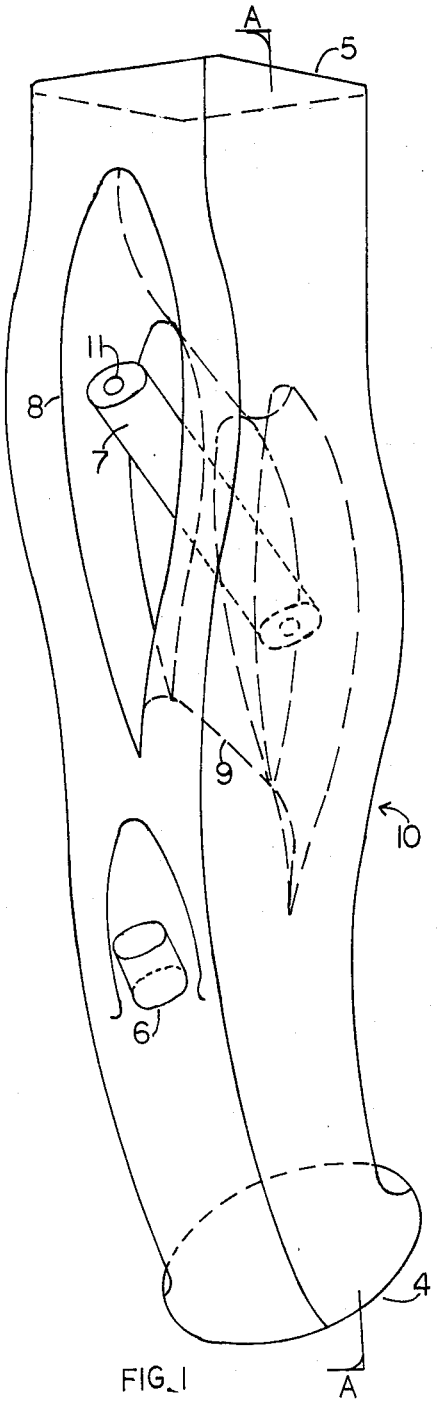
FIG. 1 shows a perspective view of the device according to the invention.
Figure 2:
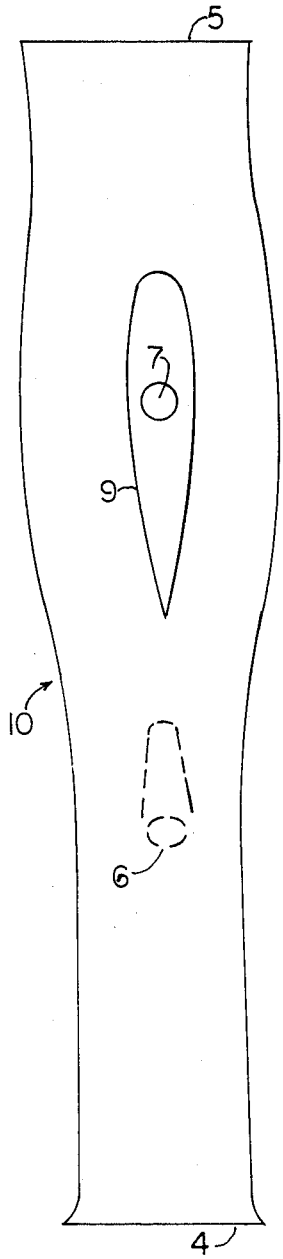
FIG. 2 shows a sectional view taken across the air foil at line A—A of FIG. 1 of the device according to the invention.

FIG. 3 is a flow chart showing the results obtained from tests of air flow on a flow bench. Testing was done with six inches of water which is the pressure differential at 72 degrees Fahrenheit. Column A, shows different valve lift values, in thousandths of inches. Column B shows monometer numbers of the flow obtained from a stock factory Aluminum High Performance Head according to the prior art. Column C shows the monometer numbers of the flow obtained from an airfoil intake port according to the present invention. The test results show a 33.8% increase in flow, a 20% increase in horsepower, and a 10–15% increase in torque.

While the above description contains many specificities, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents, and not by the examples which have been given.

DRAWING REFERENCE NUMERALS

4. valve seat
5. to intake manifold
6. valve guide
7. push rod guide
8. push rod opening
9. air foil
10. intake port
11. push rod

INTAKE PORT WITH AIR FOIL DESCRIPTION

FIG. 1 shows a device according to the present invention. The intake port 10, has the air flow entering the port from the intake manifold, at 5. The push rod guide 7, and push rod 11, pass through the intake port at the push rod opening 8. At the location of the push rod guide and push rod is an air foil form 9, which is integral with the intake port form. The valve guide 6, passes through the intake port side wall. The valve seat is shown at 4.

AIRFOIL INTAKE PORT-OPERATION

Air/fuel enters the intake port from the direction of the intake manifold, at 5. Air/fuel travels in the direction of the valve seat 4, and passes around the push rod 11, and guide 7. The push rod and guide penetrate the wall of the intake port where a push rod opening 8, receives it. The push rod opening is integral with an air foil form 9 and forms an opening in the side wall of the intake port. The tendency of the air/fuel flow at this point to be turbulent because of the barrier of the push rod and guide is substantially diminished by the airfoil form 9, which surrounds the push rod and guide and increases the efficiency of the air/fuel flow around it, as the air/fuel travels toward the valve seat 4. The valve guide 6, passes through the wall of the intake port.

While the above description contains many specificities, the reader should not construe these as limitations on the scope of the invention, but merely as exemplifications of preferred embodiments thereof. Those skilled in the art will envision many other possible variations are within its scope. For example skilled artisans will readily be able to change the dimensions and shapes of the preferred embodiment shown to incorporate the specifics required for any internal combustion engine.

What is claimed is:

1. An intake port for an internal combustion engine the device comprising, a substantially straight through intake port having an airfoil form located within said intake port, said airfoil form faring into being integral with the intake port at its perimeter, a push-rod and guide passing through the interior of said airfoil form.

2. The device according to claim 1 in which the valve stem and guide passes through the intake port.

* * * * *